US010020580B2

(12) United States Patent
Rizzo

(10) Patent No.: US 10,020,580 B2
(45) Date of Patent: Jul. 10, 2018

(54) ANTENNA FOR AN ELECTRONIC DEVICE

(71) Applicant: STMicroelectronics (Rousset) SAS, Rousset (FR)

(72) Inventor: Pierre Rizzo, Trets (FR)

(73) Assignee: STMicroelectronics (Rousset) SAS, Rousset (FR)

( * ) Notice: Subject to any disclaimer, the term of this patent is extended or adjusted under 35 U.S.C. 154(b) by 138 days.

(21) Appl. No.: 14/835,103

(22) Filed: Aug. 25, 2015

(65) Prior Publication Data

US 2016/0181696 A1 Jun. 23, 2016

(30) Foreign Application Priority Data

Dec. 18, 2014 (FR) ..... 14 62694

(51) Int. Cl.

| | |
|---|---|
| ***H01Q 7/00*** | (2006.01) |
| ***H01Q 1/24*** | (2006.01) |
| ***H01Q 1/38*** | (2006.01) |
| ***H01Q 1/50*** | (2006.01) |

(52) U.S. Cl.

CPC ..... *H01Q 7/00* (2013.01); *H01Q 1/243* (2013.01); *H01Q 1/38* (2013.01); *H01Q 1/50* (2013.01)

(58) Field of Classification Search

None

See application file for complete search history.

(56) References Cited

U.S. PATENT DOCUMENTS

| | | | | |
|---|---|---|---|---|
| 4,291,312 | A * | 9/1981 | Kaloi | H01Q 1/48 343/700 MS |
| 5,300,936 | A * | 4/1994 | Izadian | H01Q 1/32 343/700 MS |
| 6,637,665 | B2 * | 10/2003 | Salzgeber | H01Q 1/22 235/486 |
| 7,129,148 | B2 | 10/2006 | Kawamura et al. | |
| 7,446,729 | B2 * | 11/2008 | Maruyama | G06K 19/07749 343/742 |
| 7,548,207 | B1 * | 6/2009 | Chu | H01Q 1/38 343/700 MS |
| 7,586,463 | B1 * | 9/2009 | Katz | H01Q 1/08 343/718 |
| 8,058,714 | B2 * | 11/2011 | Noll | H01Q 1/40 257/678 |
| 2003/0043077 | A1 * | 3/2003 | Alexopoulos | H01P 1/2005 343/700 MS |
| 2004/0001029 | A1 * | 1/2004 | Parsche | H01Q 1/38 343/866 |
| 2005/0186902 | A1 * | 8/2005 | Lieffort | G06K 7/10178 455/41.1 |
| 2006/0055618 | A1 * | 3/2006 | Poilasne | H01Q 1/241 343/866 |

(Continued)

FOREIGN PATENT DOCUMENTS

| | | |
|---|---|---|
| CN | 103219579 A | 7/2013 |
| EP | 2 485 396 A2 | 8/2012 |

(Continued)

*Primary Examiner* — Trinh Dinh

(74) *Attorney, Agent, or Firm* — Seed IP Law Group LLP

(57) ABSTRACT

A radio or power transfer antenna, in the form of a planar conductive winding, with one of two ends of the planar conductive winding directly connected to a metal section or plane which continuously surrounds the planar conductive winding.

19 Claims, 2 Drawing Sheets

(56) References Cited

U.S. PATENT DOCUMENTS

| | | | | |
|---|---|---|---|---|
| 2007/0164907 | A1* | 7/2007 | Gaucher | H01Q 1/2283 343/700 MS |
| 2009/0273418 | A1* | 11/2009 | Shimizu | H01Q 13/10 333/24 R |
| 2011/0287715 | A1 | 11/2011 | Matsuura et al. | |
| 2012/0200472 | A1* | 8/2012 | Tramoni | H03H 7/40 343/861 |
| 2013/0127573 | A1* | 5/2013 | Nakano | G06K 7/10009 336/115 |
| 2013/0214986 | A1* | 8/2013 | Zhu | H01Q 1/243 343/848 |
| 2013/0241790 | A1* | 9/2013 | Prioul | H01Q 1/04 343/843 |
| 2014/0203992 | A1* | 7/2014 | Nakano | H01Q 7/00 343/867 |
| 2015/0229018 | A1* | 8/2015 | Pope | H01Q 1/24 343/702 |

FOREIGN PATENT DOCUMENTS

| | | | |
|---|---|---|---|
| EP | 2 557 630 | A1 | 2/2013 |
| WO | 2011/095207 | A1 | 8/2011 |
| WO | 2014/106490 | A1 | 7/2014 |

* cited by examiner

ANTENNA FOR AN ELECTRONIC DEVICE

BACKGROUND

Technical Field

The present disclosure generally relates to electronic devices and, more particularly, to devices using a radio communication or power transfer antenna.

Description of the Related Art

More and more electronic devices are so-called "communicating" devices. For most of these, the communication is performed in radio frequency mode, be it passively (electronic tag including only passive components) or actively (electronic tag or device including one or a plurality of active circuits).

In particular, cell phone type devices are more and more often provided with a near-field communication function (NFC) enabling electronic circuits of the phone to communicate wireless and contactless with similar devices, electronic tags, mobile-optimized players, etc. The phone then generally includes an interface of communication between an antenna and its circuits. This interface is generally called radio frequency front end or contactless front end (CLF). One of a plurality of antennas is then connected to this RF front end for radio communications.

In such devices and more generally in any electronic device provided with an RF communication and/or power transfer antenna, the integration of the antenna (or of the antennas) in the device conditions the performance thereof, and thus of the communication and/or power transfer.

BRIEF SUMMARY

An embodiment aims at overcoming all or part of the disadvantages of electronic devices provided with radio communication and/or power transfer antennas.

An embodiment aims at providing a novel solution of antenna integration in an electronic device.

An embodiment aims at a solution particularly adapted to an antenna intended to be connected to a radio communication front end of an electronic device.

An embodiment aims at providing a solution particularly adapted to the integration of an antenna in a metallic environment.

Thus, an embodiment provides a radio communication or power transfer antenna made in the form of a planar conductor winding, wherein one of the two ends of the planar winding is directly connected to a metallic section or plane which continuously surrounds the planar winding.

According to an embodiment, the metallic section or plane is intended to be grounded.

According to an embodiment, the end connected to the section or plane is the external end of the winding.

According to an embodiment, the plane comprises an opening having the planar winding placed therein.

According to an embodiment, the winding is inscribed within an outer diameter in the range from approximately 5 to approximately 20 mm.

According to an embodiment, the center of the winding is inscribed within a diameter in the range from 2 to 5 mm.

An embodiment provides a radio frequency circuit comprising:

an antenna;

a radio frequency front end; and a matching network provided, between each end of the winding and a terminal of the circuit, with a first capacitive element.

According to an embodiment, the matching network further comprises a second capacitive element connecting the two ends of the winding.

An embodiment provides an electronic device integrating an antenna and/or a radio frequency circuit.

According to an embodiment, the opening of the metal plane is intended to receive a camera, a microphone, or a light sensor.

According to an embodiment, the metal plane is a cell phone shell.

The foregoing and other features and advantages will be discussed in detail in the following non-limiting description of specific embodiments in connection with the accompanying drawings.

DETAILED DESCRIPTION

Figure 1:
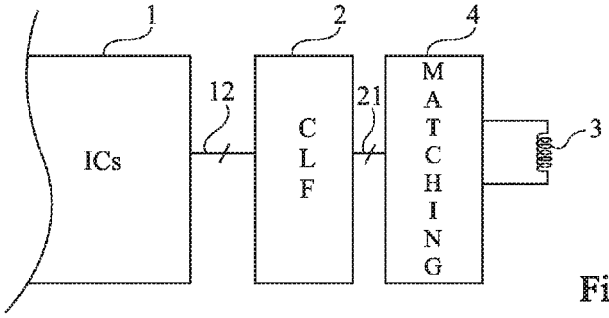
FIG. 1 schematically shows, in the form of blocks, an example of an electronic circuit architecture of the type to which the embodiments which will be described apply.

The same elements have been designated with the same reference numerals in the different drawings. In particular, the structural and/or functional elements common to the different embodiments may be designated with the same reference numerals and may have identical structural, dimensional, and material properties. For clarity, only those steps and elements which are useful to the understanding of the described embodiments have been shown and will be detailed. In particular, the generation and the processing of the communications transmitted or sensed by the described antenna have not been shown, the described embodiments being compatible with usual applications. Further, the rest of the electronic device integrating an antenna has not been detailed either, the described embodiments being here again compatible with the rest of the elements forming electronic devices integrating one or a plurality of radio communication or power transfer antennas. In the following description, when reference is made to terms "about", "approximately", or "in the order of", this means to within 10%, preferably to within 5%.

In the present description, reference is more particularly made to an example of application to an electronic device of cell phone type provided with near field communication functions. However, all that will be described more generally applies to any other electronic device integrating a radio communication or power transfer antenna to be placed in a metallic environment.

FIG. 1 schematically shows, in the form of blocks, an example of an electronic circuit architecture of the type to which the embodiments which will be described apply.

It for example is a cell phone having near-field communication functions. Electronic circuits 1 (ICs) of the device are capable of exchanging signals (connection 12) with a contactless front end 2 (CLF) forming an interface between circuits 1 and an antenna 3. A matching network 4 (MATCHING), forming a frequency tuning and impedance matching circuit, is interposed between radio frequency inputs-outputs 21 of front end 2 and antenna 3. The antenna is generally formed of a planar conductive winding.

The operation of such an architecture is known and will not be detailed, since the described embodiments do not modify the operation in terms of generation and processing of the signals by the different elements.

The position of the antenna in the device may sometimes be opposite a metal plate (typically an element of a package of the device such as the shell of a cell phone). An opening then has to be made in this metal element to place the planar winding forming the antenna in this opening.

Figure 2A:
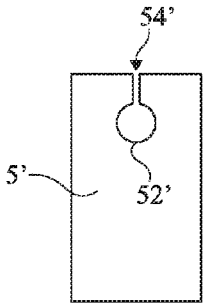
Fig 2A (Background Art)
FIGS. 2A, 2B, and 2C illustrate an example of a usual antenna layout at the level of a metal plane of an electronic device.
Figure 2B:
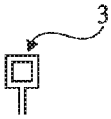
Fig 2B (Background Art)
Figure 2C:
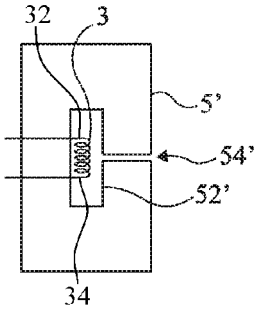
Fig 2C (Background Art)

FIGS. 2A, 2B, and 2C illustrate an example of a usual layout at the level of a metal plane 5' of an electronic device. FIG. 2A schematically shows metal plane 5'. FIG. 2B shows an example of a planar conductive winding forming antenna 3. FIG. 2C shows the equivalent electric diagram of the assembly.

In this example antenna 3 is desired to be placed under the metal shell of the cell phone forming metal plane 5'. Winding 3 is then at least partially placed inside of an opening 52' of the metal plane to allow the radio communication and allow the field lines to pass through the antenna. Advantage is taken of the presence of an opening generally present for other purposes, for example, for an electronic camera, a microphone, a light sensor, etc. The two ends 32 and 34 of winding 3 are connected to matching network 4 (FIG. 1). This connection is performed with insulated wires and/or with conductive tracks deposited on an insulating layer (not shown) at least partially covering the internal surface of plate 5'.

The presence of the metal plane disturbs the communication and, to avoid the adverse consequences of eddy currents, a slot 54' has to be made in metal plane 5', so that opening 52' emerges, through slot 54', out of an edge of metal plane 5'.

The need for a slot 54' complicates the forming and is generally not desired. Further, this fragilizes the shell or metal package.

Figure 3:
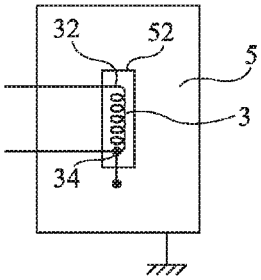
FIG. 3 is a simplified representation of an antenna according to an embodiment of the present disclosure.

FIG. 3 is a simplified representation of an antenna according to an embodiment of the present disclosure. This drawing shows an equivalent diagram to be compared with FIG. 2C.

According to this embodiment, antenna 3 is formed of a planar winding placed in an opening 52 of a metal plane 5. Conversely to FIG. 2C, the contour of opening 52 is closed, that is, opening 52 does not emerge out of one of the edges of plane 5. Another difference is that one of the ends, for example, external end 34, of the winding forming antenna 3 is connected to metal plane 5, which is itself connected to the ground of the electronic device. Further, winding 3 is entirely contained within the opening 52.

The inventor has observed that, surprisingly, by electrically connecting one end of the antenna to the ground plane surrounding it, the disturbances due to eddy currents are considerably decreased and the antenna performance is improved, including if the opening where the antenna is placed has a closed contour.

Figure 4:
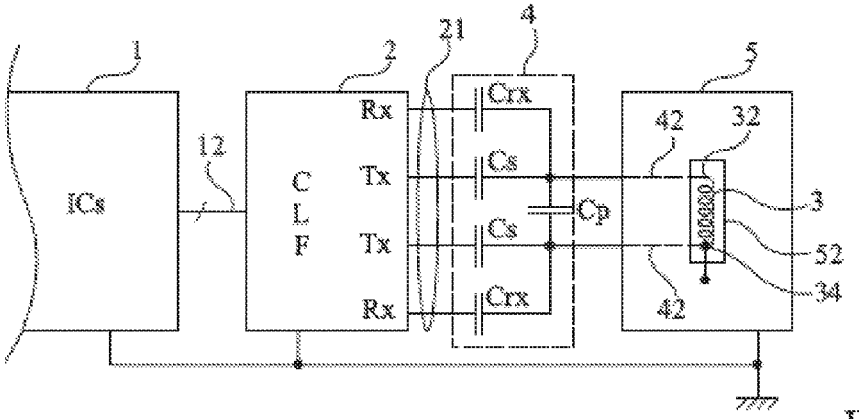
FIG. 4 schematically and partially shows an embodiment of an electronic device integrating an antenna of the type in FIG. 3.

FIG. 4 schematically and partially shows an embodiment of an electronic device integrating an antenna of the type in FIG. 3.

It shows electronic circuits 1 (ICs) of the device, capable of exchanging signals (link 12) with a contactless front end 2 (CLF) forming an interface between circuits 1 and an antenna 3. A matching network 4 (MATCHING), forming a frequency tuning and impedance matching circuit, is interposed between the radio frequency inputs-outputs of front end 2 and antenna 3. In the example of FIG. 4, a front end 2 comprising two differential-mode signal receive terminals Rx and two differential-mode signal transmit terminals Tx is considered.

Terminals Rx and terminals Tx of front end 2 are intended to be connected to the ends of the antenna winding, via a matching network 4. Matching network 4 comprises at least one capacitive element in series between each terminal Rx or Tx and the end of the winding to which this terminal should be connected. For example, capacitors Cs are interposed between terminals Tx and ends 32 and 34 and capacitors Crx are interposed between terminals Rx and ends 32 and 34. Further, a capacitive element Cp generally interconnects ends 32 and 34. The capacitors of network 4, and particularly capacitor CP, take part in the frequency tuning of the oscillating circuit comprising antenna 3, both in read mode (generation of a field) by matching the output impedance seen from terminals Tx to the antenna impedance, and in card or receive mode by matching the impedance to have a resonant circuit having a resonance frequency close to the carrier frequency.

While grounding one of the ends of winding 3 could be considered prejudicial since this would introduce a common-mode component in the signals received or transmitted by front end 2, the presence at the level of matching network 4 of series-connected capacitors, between each terminal of circuit 2 and end 32 or 34 to which this terminal is connected, filters this common-mode component which would otherwise be introduced by the ground.

The two ends 32 and 34 of winding 3 are connected to matching network 4 by insulated wires 42 and/or by conductive tracks deposited on an insulating layer (not shown) at least partially covering the internal surface of plate 5.

Figure 5A:
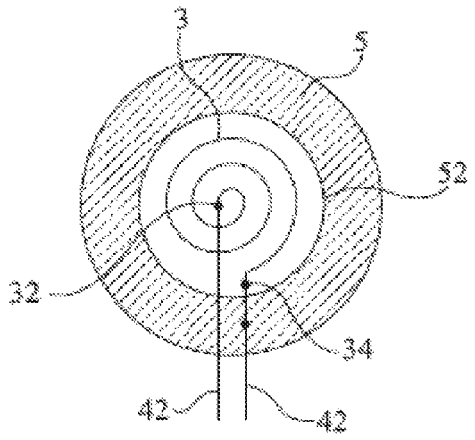
FIGS. 5A and 5B are simplified representations of two embodiments of an antenna.
Figure 5B:
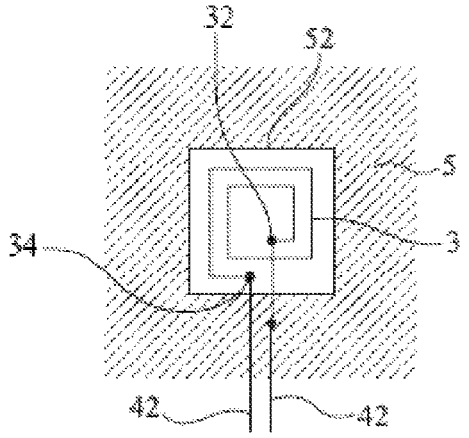

FIGS. 5A and 5B are simplified representations of two embodiments of an antenna 3.

FIG. 5A illustrates the forming of an antenna 3 in the form of a circular planar winding surrounded with a conductive section 5, also circular. In the example of FIG. 5A, the external end 34 of winding 3 is connected to section 5.

FIG. 5B illustrates the case of a square-shaped planar conductive winding 3 placed in an opening 52, itself square-shaped, formed in a metal plane 5. In the example of FIG. 5B, the internal end 32 of winding 3 is connected to section 5.

Figure 6:
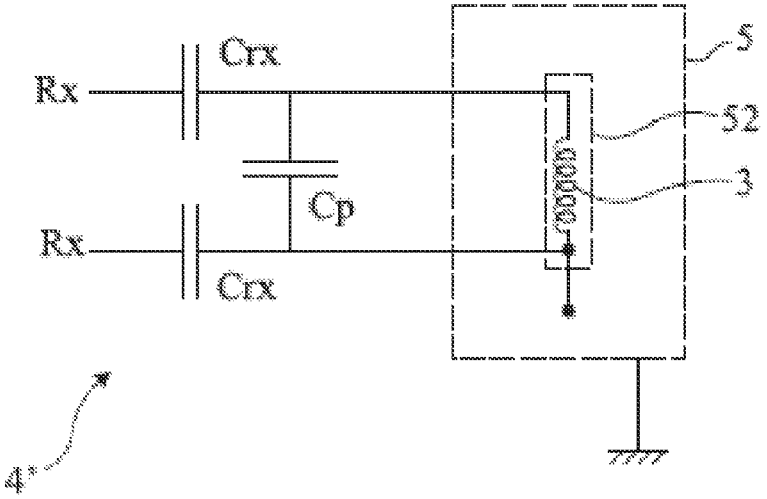
FIG. 6 shows an alternative embodiment of a matching network between an antenna and a radio frequency front end.

FIG. 6 shows an alternative embodiment of a matching network 4' between an antenna 3 and a contactless front end. This for example concerns a case where the transmit and receive modes are each associated with a different antenna.

In this example, the antenna is assumed to only be used to receive data and to send back data by load modulation (card emulation mode). Network 4' then comprises a capacitor Crx between each terminal Rx and end 32 or 34 of the antenna to which the terminal should be connected and a capacitor Cp connecting the two ends 32 and 34 of the antenna.

Figure 7:
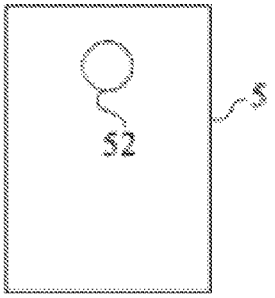
FIG. 7 is a view to be compared with that of FIG. 2A of a metal cover of an electronic device.

FIG. 7 is a view to be compared with that of FIG. 2A of a metal shell of an electronic device.

As appears from FIG. 7, opening 52 (here, circular), for example, for an electronic camera, a microphone, a light sensor, etc., where antenna 3 (not shown in FIG. 7) is placed has a closed contour and does not emerge out of one of the edges of shell 5.

As a specific embodiment, winding 3 has an external diameter or is inscribed within a diameter in the range from approximately 5 to approximately 20 mm and the center of the winding has a diameter or is inscribed within a diameter in the range from 2 to 5 mm.

An advantage of the described embodiments is that it is now possible to associate an antenna with a device having a metal wall.

Another advantage is that it is not necessary to interrupt the electric continuity of such a metallic environment around the antenna, which can now be surrounded with a ground plane.

The performance of an antenna thus formed is considerably improved.

Thus, the inventor has been able to make the following comparative measurements. A 6-mm antenna inscribed within a square opening having a 10 mm side length as a retromodulation level, 3 cm away from the antenna of a test reader, which is from 3 to 4 times greater than the level obtained for a same antenna having the external end of its winding unconnected to the ground plane.

According to another example of application, an antenna formed with a connection of an end to a ground plane is formed at the rear surface (generally metallic) of a flat liquid crystal display and connected to the ground thereof.

Various embodiments have been described. Various alterations, modifications, and improvements will occur to those skilled in the art. In particular, the shape of the metal plane surrounding the antenna and to which the antenna is connected depends on applications and on the shape of the electronic device having the antenna integrated therein. Similarly, the shape of the opening formed in the metal plane depends on applications and different variations are possible provided for this opening to be closed, that is, provided for it not to emerge out of one of the edges of the plane. Further, other structures of matching network 4 may be provided, provided to respect an insulation of the common mode between the terminals of transmit and/or receive circuit 2 and ends 32 and 34 of the winding forming antenna 3. Further, the described embodiments are particularly adapted to circuits performing an active retromodulation, that is, not only modulating the load of the antenna but also taking part in providing energy thereto. Finally, the practical implementation of the embodiments which have been described is within the abilities of those skilled in the art based on the functional indications given here above.

Such alterations, modifications, and improvements are intended to be part of this disclosure, and are intended to be within the spirit and the scope of the present disclosure. Accordingly, the foregoing description is by way of example only and is not intended to be limiting of the present invention, which is limited only as defined in the following claims and the equivalents thereto.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An antenna, comprising:

a planar conductive winding formed in a plane and having a first end and a second end; and a metal section formed in the plane of the planar conductive winding and continuously surrounding the planar conductive winding, the first end of the planar winding connected to the metal section and the second end not connected to the metal section, and the metal section connected to a ground plane.

2. The antenna of claim 1, wherein the second end of the planar conductive winding is an internal end and wherein the first end of the planar conductive winding is an external end connected to the metal section.

3. The antenna of claim 1, wherein the metal section comprises an opening and the planar conductive winding is placed in the opening.

4. The antenna of claim 3, wherein the metal section opening is one of a circular shaped opening and a square shaped opening.

5. The antenna of claim 1, wherein the winding is inscribed within an external diameter in the range from approximately 5 to approximately 20 mm.

6. The antenna of claim 1, wherein the center of the winding is inscribed within a diameter in the range from 2 to 5 mm.

7. A radio frequency circuit, comprising:

an antenna including a planar conductive winding having two ends, one of the two ends connected to a conductive section which continuously surrounds the planar conductive winding;

a contactless front end circuit including inputs and outputs; and a matching network coupled between the inputs and outputs of the contactless front end circuit and the antenna, the matching network including a first capacitive element provided between each end of the planar conductive winding and a corresponding input or output of the contactless front end circuit.

8. The circuit of claim 7, wherein the matching network further comprises a second capacitive element connecting the two ends of the planar conductive winding.

9. The radio frequency circuit of claim 7, wherein the conductive section includes opening and wherein the planar winding is positioned within the opening.

10. The radio frequency circuit of claim 9, wherein the two ends of the planar winding comprise an internal end and an external end, and wherein the external end of the planar winding is the end connected to the conductive section.

11. The radio frequency circuit of claim 10, wherein the conductive section comprises a metal section.

12. The radio frequency circuit of claim 11, wherein the metal section is coupled to receive a ground voltage.

13. An electronic device, comprising:

electronic circuitry; and a radio frequency circuit coupled to the electronic circuitry, the radio frequency circuit including, an antenna having a planar conductive winding with two ends, one of the ends being connected to a metal plane that continuously surrounds the planar conductive winding;

a contactless front end circuit including a plurality of terminals; and a matching network coupled between the contactless front end circuit and the antenna, wherein the matching network includes a first capacitive element connected between each end of the planar conductive winding and a corresponding one of the terminals of the contactless front end circuit.

14. The electronic device of claim 13, wherein an opening of the metal plane in which the antenna is located is also configured to receive a camera, a microphone, or a light sensor.

15. The electronic device of claim 14, wherein the electronic circuitry comprises cell phone circuitry.

16. The electronic device of claim 15, wherein the metal plane comprises a cell phone shell.

17. The electronic device of claim 13, wherein the metal plane includes opening and wherein the planar winding is positioned within the opening.

18. The electronic device of claim 17, wherein the opening comprises one of a circular shaped opening and a square shaped opening.

19. The electronic device of claim 18, wherein the two ends of the planar winding comprise an internal end and an external end, and wherein the external end of the planar winding is the end connected to the metal plane.

* * * * *